US009125271B2

(12) United States Patent
Martins et al.

(10) Patent No.: US 9,125,271 B2
(45) Date of Patent: Sep. 1, 2015

(54) THREE-WAY LAMP WITH PROGRAMMABLE OUTPUT LEVELS

(71) Applicant: GE Lighting Solutions, LLC, East Cleveland, OH (US)

(72) Inventors: Jeremias Anthony Martins, Twinsburg, OH (US); Bruce Richard Roberts, Mentor-on-the-Lake, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/013,157

(22) Filed: Aug. 29, 2013

(65) Prior Publication Data

US 2015/0061497 A1 Mar. 5, 2015

(51) Int. Cl.
*H05B 33/08* (2006.01)
*F21S 8/10* (2006.01)

(52) U.S. Cl.
CPC ..... *H05B 33/0845* (2013.01)

(58) Field of Classification Search
None
See application file for complete search history.

(56) References Cited

U.S. PATENT DOCUMENTS

| | | | | |
|---|---|---|---|---|
| 6,940,230 | B2 | 9/2005 | Myron | |
| 7,161,313 | B2 * | 1/2007 | Piepgras et al. | 315/318 |
| 8,272,766 | B2 * | 9/2012 | Phipps et al. | 362/294 |
| 2008/0130288 | A1 | 6/2008 | Catalano et al. | |
| 2011/0175528 | A1 * | 7/2011 | Rains et al. | 315/51 |
| 2013/0140988 | A1 | 6/2013 | Maxik et al. | |
| 2014/0152187 | A1 * | 6/2014 | Lin et al. | 315/200 R |

FOREIGN PATENT DOCUMENTS

| | | | |
|---|---|---|---|
| DE | 19814488 | A1 | 10/1999 |
| KR | 20120065032 | A | 6/2012 |
| RU | 103956 | U | 11/2010 |
| WO | 2010148113 | A2 | 12/2010 |
| WO | 2013090945 | A1 | 6/2013 |

OTHER PUBLICATIONS

WO Search Report and Written Opinion issued in connection with corresponding WO Application No. PCT/US2014/048095 dated Nov. 13, 2014.

* cited by examiner

*Primary Examiner* — Douglas W Owens
*Assistant Examiner* — Dedei K Hammond
(74) *Attorney, Agent, or Firm* — GE Global Patent Operation; Peter T. DiMauro

(57) ABSTRACT

A lamp including a lamp base having at least three electrical contacts, an optical housing with an LED light source distal from the lamp base, a capper assembly including two or more bias switches accessible by a user located between the lamp base and optical housing, electronic circuitry located within the capper assembly, the electronic circuitry electrically coupled to the three electrical contacts and the LED light source, the electronic circuitry configured to provide a drive current to the LED light source, and the two or more bias switches are user-settable to set the drive current. The electronic circuitry provides at least two different levels of drive current to the LED light source, where the two or more bias switches are configured to control multiple levels of LED light intensity to an individual level.

15 Claims, 3 Drawing Sheets

THREE-WAY LAMP WITH PROGRAMMABLE OUTPUT LEVELS

BACKGROUND

A three-way lamp, e.g., three way incandescent lamp, produces three levels of light intensity (i.e., low, medium, and high), typically using two lamp filaments within the same optical housing. The two filaments are typically of different wattages. For example, one lamp filament can be a low wattage filament, and the other filament can be a high wattage filament.

Conventionally, these two filaments are connected in parallel to the lamp base. The lamp base itself has two contacts and a neutral contact. Each of the filaments operates at full voltage when activated.

Proper installation of the three-way lamp is achieved by using a three-way lamp socket, which has three contacts instead of the usual two for a single filament lamp. This third contact is typically off center in the bottom of the socket, and makes contact with the second filament circuit.

The three-way lamp is controlled using a three-way switch, which itself has four positions. Starting from the 'off' position, the switch can sequentially connect power to one filament (typically the lower wattage filament,), then the other filament, and then both filaments.

DETAILED DESCRIPTION

In accordance with embodiments, a three-way lamp includes light emitting diodes (LED) as light sources, two AC input terminals, and two or more bias switches accessible on an outer surface of the lamp. In one implementation, there can be three bias switches. These bias switches can be used to set the light intensity level produced by the LED light sources depending on the AC input presence (at one terminal, the other terminal, or both AC input terminals). The bias switches themselves can be located on the lamp's capper to be readily accessible by a user, so that the three light illumination intensity output levels of the three-way lamp can be programmed by the user.

Figure 1:
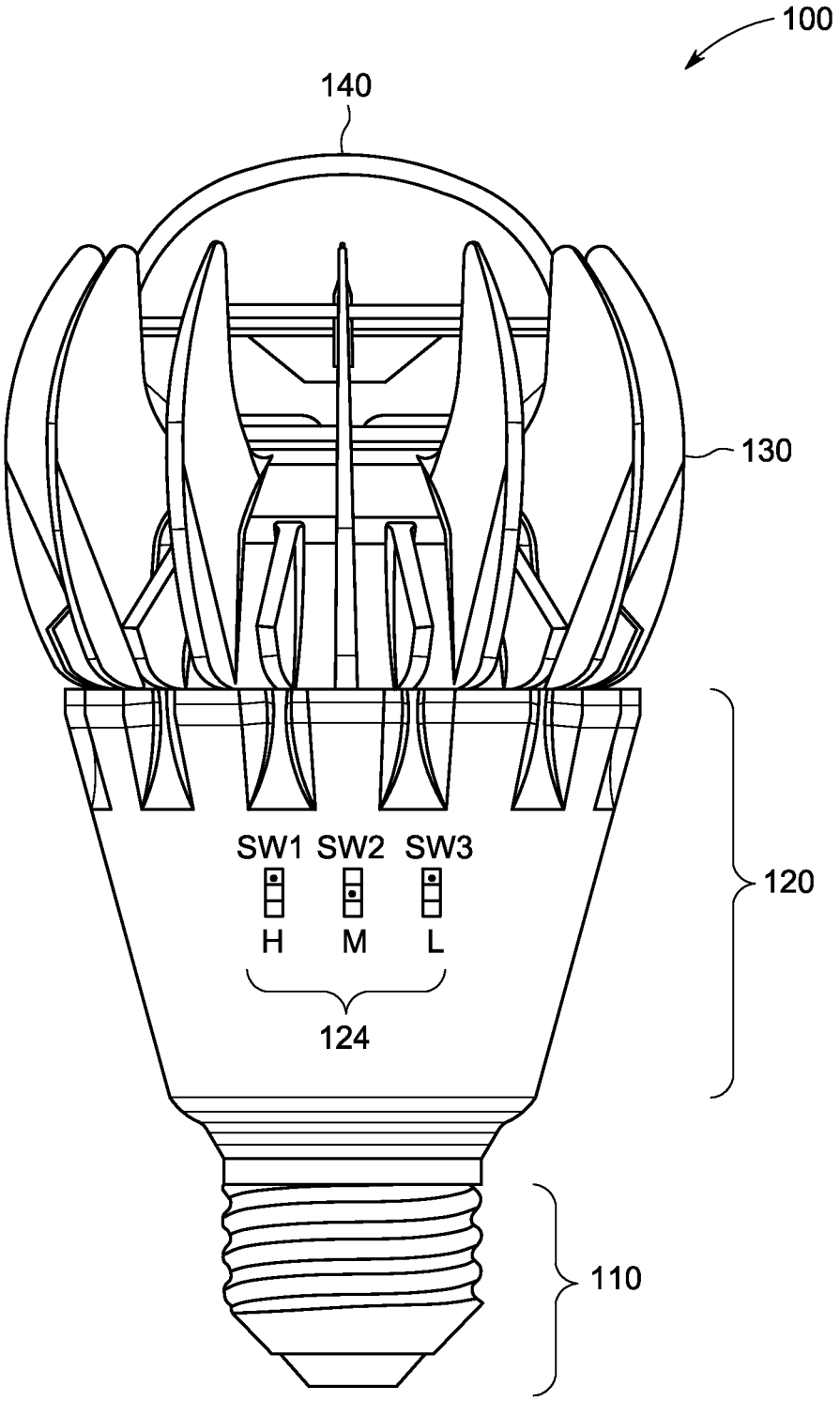
FIG. 1 depicts a three-way lamp in accordance with some embodiments.

FIG. 1 is a perspective view of three-way lamp 100 in accordance with some embodiments. Three-way lamp 100 includes lamp base 110, which has three contacts (two AC input terminals and a neutral terminal). Also included in the three-way lamp are capper 120, heat sink 130, and optical housing 140. LED light source(s) are housed within optical housing 140 are adjacent thereto. Capper 120 houses electronic circuitry, and on its outer shell includes openings for bias switches 124. The electronic circuitry is electrically coupled to the contacts on the lamp base and the LED light source(s). The heat sink is thermally coupled to the LED light source(s) and/or the electronic circuitry to conduct heat away. In accordance with an embodiment, bias switches 124 can be three in number, and have a single pole with multiple (e.g., three or more positions). Various types of bias switches (for example, rotary switches), and with other number of positions are readily implemented in other embodiments. Bias switches 124 are user-settable and set the drive current level provided from the electronic circuitry to the LED light source (s) so as to change the emitted light intensity of lamp 100 based on the presence and/or non-presence of input voltage on the lamp base contacts.

Figure 2:
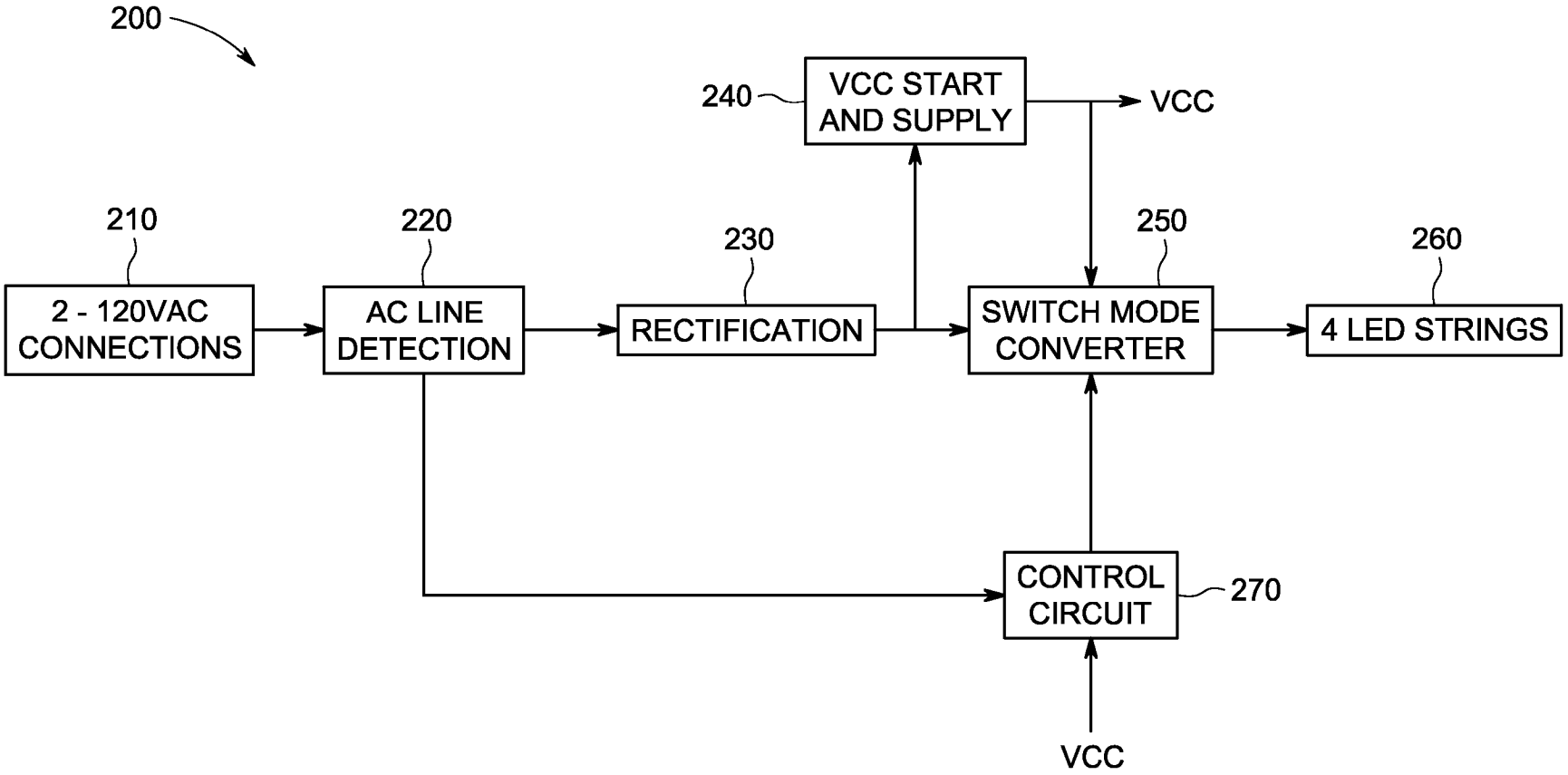
FIG. 2 depicts a block diagram of a three-way lamp in accordance with some embodiments.

FIG. 2 is a block diagram of three-way lamp electronic circuit 200 in accordance with some embodiments. Input 210 includes two AC line terminals, and a neutral terminal. Selection of a switch connected to a three-way socket provides AC voltage to one terminal, the other terminal, or both terminals.

AC line detector 220 detects the presence of AC voltage on the terminal(s) of input 210. Rectifier 230 rectifies the AC voltage. In one implementation, the rectifier can be a full wave rectifier, and can include an EMI filter stage.

The rectified voltage is provided to power supply 240, where an auxiliary regulator circuit develops the DC supply voltage used by electronic circuitry. Also connected to the rectifier is switch mode converter 250, which generates a controlled DC voltage that drives LED light sources 260. This controlled DC voltage is tightly regulated to provide the desired current to the LED light sources. Thus, effectively acting as a constant current source to the LED strings.

The level of the LED drive current from the switch mode converter is adjusted by an input from control circuit 270. The control circuit receives signals from the AC line detector, and includes circuitry that sets the current level(s) for the LED light sources. The user adjustable bias switches help to bias this circuitry to set the LED light source current level(s). Control circuit 270 controls the power levels depending on the AC line input selection and the bias switch settings.

LED light sources can be a LED Chip on Board, a set of LED die, or LED packages in strings. In accordance with one embodiment, four of these LED light sources can be serially connected to form LED strings. This series string of LEDs can then be repeated (e.g., four times) for a total of 16 LED packages as light source LED string 260. In accordance with some embodiments, all of the LED light sources receive the drive power from the switch mode converter. The light intensity of the LED light sources varies with the AC line input selection, as impacted by the bias switch selections made by the user.

In accordance with some embodiments, the user can program three-way lamp 100 to particular illumination levels by varying the setting of the three bias switches located on the shell of capper 120. In one implementation, the bias switches can be DIP switches. Other implementations of the bias switches could include rotary dial switches, etc.

Bias switches 124 can control the three illumination intensity levels of the three-way lamp to an individual level. The three illumination output levels can be controlled independently unlike the dependency between illumination levels of the conventional three-way lamp. Conventional three-way lamps have illumination levels determined by the wattage of the two filaments that produce the three illumination levels. For example, in a conventional three-way lamp the filaments can be 50 and 100 watts, so the lamp can only produce illumination levels of 50, 100 and 150 watts.

In accordance with embodiments, three-way lamp 100 can control each basic level in the driver electronics. By use of the bias switches the output level can be controlled to a finer level. For example, depending on the internal bias circuitry values selected by the bias switches, bias switch SW1 (FIG. 1) can control the high level to a 100, 125, or 150 watt equivalent output; bias switch SW2 can control the medium output level to 60, 75, 100 watt equivalent; and bias switch SW3 can control the low level output to 30, 40, of 60 watt equivalent output. In accordance with embodiments, each of the bias switch levels is independent from the other. By incorporating LED light source technology and bias switches to adjust the power level of the LED driver circuit output, the user can now adjust the illumination intensity levels of three-way lamp 100 to user-specific levels.

Figure 3:
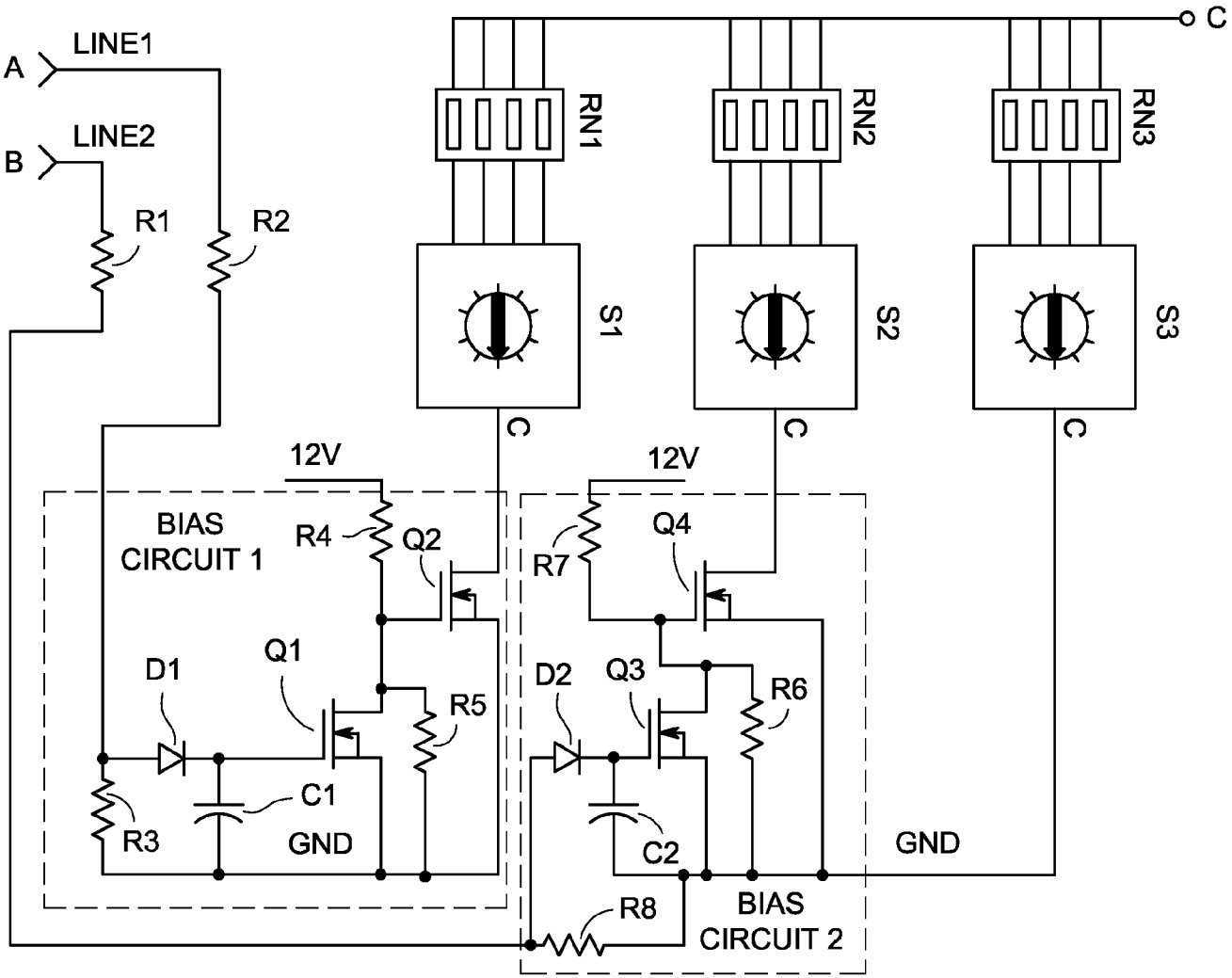
FIG. 3 depicts a schematic circuit diagram of a three-way lamp in accordance with some embodiments.

FIG. 3 depicts a schematic circuit diagram of control circuit 270 of three-way lamp 100 in accordance with some embodiments. Control circuit 270 includes bias circuit 1 and bias circuit 2, which can be identical circuits in accordance with some embodiments.

If the lamp fixture three-way switch is selected so that an AC input is present on both AC line 1 and AC line 2 (points A and B), then transistors Q1, Q2, Q3, Q4 are operative which effectively removes parallel resistor networks RN1, RN2 and selector switches S1, S2 from the circuit. In this situation, the LED driver power is solely determined by the resistance of resistor network RN3 as selected by the setting of bias switch S3.

If either of the two input AC lines is singularly active, then the absence of power on the other AC line disables that bias circuit's transistors. For example, if AC line 1 has no AC input connected, then Q1 is turned off, which raises the gate voltage of Q2 and turns Q2 on. The resistance of resistor network RN1 is selected by switch S1, and is in parallel (to ground through transistor Q2) with the resistance of resistor network RN3 as selected by switch S3. Thus, lowering the resistance path of control point C to ground, and lowering the output current set point (Point C). This change in resistance (increase or decrease) can be predetermined by setting the bias switches S1, S2, S3 to various positions. Although transistors Q1, Q2, Q3, Q4 are depicted as re-channel FETS, other implementations can include other switching elements such as p-channel FETS, bipolar junction transistors, etc.

Although specific hardware and methods have been described herein, note that any number of other configurations may be provided in accordance with embodiments of the invention. Thus, while there have been shown, described, and pointed out fundamental novel features of the invention, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

The invention claimed is:

1. A lamp comprising:

a lamp base having at least three electrical contacts;

an optical housing located distal from the lamp base;

a light emitting diode (LED) light source within the optical housing;

a capper assembly located between the lamp base and the optical housing;

the capper assembly including two or more bias switches accessible by a user;

electronic circuitry located within the capper assembly, the electronic circuitry electrically coupled to the three electrical contacts and the LED light source;

the electronic circuitry including a respective bias circuit for each of the two or more bias switches;

each of the respective bias circuits configured to provide a respective drive current to the LED light source, each respective drive current independent of other of the respective drive current;

the electronic circuitry configured to remove one of the respective drive currents based on an input voltage on at least one of the three electrical contacts; and the two or more bias switches are user-settable to set the drive current.

2. The lamp of claim 1, wherein the at least three electrical contacts include a neutral terminal and two input terminals.

3. The lamp of claim 1, wherein the two or more bias switches are single pole, multiple throw switches.

4. The lamp of claim 1, including three bias switches.

5. The lamp of claim 1, wherein the electronic circuitry provides at least two different levels of drive current to the LED light source.

6. The lamp of claim 1, including a heat sink thermally coupled to at least the electronic circuitry.

7. The lamp of claim 1, including the two or more bias switches configured to control multiple levels of LED light intensity to an individual level.

8. The lamp of claim 1, including the electronic circuitry configured to remove two of the respective drive currents with an input voltage on at least two of the three electrical contacts.

9. A lamp having a lamp base, an optical housing distal from the lamp base, and a light emitting diode (LED) light source within the optical housing comprising:

a capper assembly located between the lamp base and the optical housing, the capper assembly having electronic circuitry located within the capper assembly, the electronic circuitry electrically coupled to three electrical input contacts and the LED light source;

the electronic circuitry including an input line voltage detector, a rectifier, a control circuit, and a switch mode converter electrically coupled to the rectifier;

the switch mode converter configured to generate a controlled voltage that drives the LED light source;

the capper assembly including two or more bias switches electrically coupled to respective bias circuits configured to provide respective drive currents to the switch mode converter, each respective drive current independent of other of the respective drive currents, wherein the two or more bias switches are user-settable to set the respective independent drive current provided to the switch mode converter to generate the controlled voltage; and the control circuit controlling the LED light source level based on settings of the two or more bias switches and an AC line input selection signal from the input line voltage detector.

10. The lamp of claim 9, including at least three electrical contacts on the lamp base.

11. The lamp of claim 10, including:

the input line voltage detector is configured to detect the presence of a line voltage on one or more of the at least three electrical contacts; and in response to the detection of a line voltage presence, the input line voltage detector is further configured to provide signals that cause the electronic circuitry to adjust the drive current level.

12. The lamp of claim 9, wherein the two or more bias switches are single pole, multiple throw switches.

13. The lamp of claim 9, including three bias switches.

14. The lamp of claim 9, wherein the electronic circuitry provides at least two different levels of drive current to the LED light source.

15. The lamp of claim 9, including the two or more bias switches configured to control multiple levels of LED light intensity to an individual level.

* * * * *